US006708851B2

(12) United States Patent
DaSilva

(10) Patent No.: US 6,708,851 B2
(45) Date of Patent: Mar. 23, 2004

(54) MATERIAL ACTIVATOR FOR MATERIAL DISPENSING BIN

(75) Inventor: Brian DaSilva, Oshawa (CA)

(73) Assignee: Mould-Tek Industries, Inc., Scarborough (CA)

( * ) Notice: Subject to any disclaimer, the term of this patent is extended or adjusted under 35 U.S.C. 154(b) by 2 days.

(21) Appl. No.: 10/209,304

(22) Filed: Jul. 31, 2002

(65) Prior Publication Data

US 2003/0024945 A1 Feb. 6, 2003

Related U.S. Application Data

(60) Provisional application No. 60/308,850, filed on Aug. 21, 2001.

(51) Int. Cl.[7] ..... B65D 88/64
(52) U.S. Cl. ..... 222/200
(58) Field of Search ..... 222/198, 199, 222/200, 334; 198/533; B65D 88/64

(56) References Cited

U.S. PATENT DOCUMENTS

| | | | | | |
|---|---|---|---|---|---|
| 2,254,448 | A | * | 9/1941 | Pursel | 222/200 |
| 2,319,177 | A | * | 5/1943 | Wright | 222/200 |
| 2,740,561 | A | * | 4/1956 | Coffman, Jr. | 222/200 |
| 3,715,059 | A | * | 2/1973 | Hyer | 222/199 |
| 3,773,231 | A | * | 11/1973 | Wahl | 222/199 |
| 3,804,304 | A | | 4/1974 | Richter | |
| 4,176,767 | A | | 12/1979 | Franche, IV | |
| 4,346,802 | A | * | 8/1982 | Popper | 222/200 |
| 4,522,500 | A | * | 6/1985 | Hyer | 222/199 |
| 4,691,843 | A | * | 9/1987 | Dunan | 222/199 |
| 5,277,337 | A | | 1/1994 | Ford et al. | |

FOREIGN PATENT DOCUMENTS

| | | | | |
|---|---|---|---|---|
| CA | 1048457 | | 2/1979 | |
| CA | 1178934 | | 12/1984 | |
| DE | 2029046 | A1 * | 12/1971 | B65G/88/64 |
| FR | 2634744 | A1 * | 2/1990 | B65D/88/72 |
| JP | 03212391 | A * | 9/1991 | B65D/88/64 |
| JP | 10310195 | A * | 11/1998 | B65D/88/64 |
| SU | 1359218 | A * | 12/1987 | B65D/88/64 |
| SU | 1788937 | A3 * | 1/1993 | B65D/88/64 |

* cited by examiner

*Primary Examiner*—Kenneth Bomberg
(74) *Attorney, Agent, or Firm*—Alston & Bird LLP

(57) ABSTRACT

A device for maintaining material flow that can be mounted on either the inside or outside surface of a material dispensing bin. The device includes a material disrupting slide, attached to a reciprocating piston rod that is actuated by a pneumatic or hydraulic cylinder. The reciprocating piston rod may be either circular or non-circular in cross-section, the design defining whether the rod be fixed or non-fixed with respect to longitudinal rotation. To maintain material flow, the device is mounted in a region in the bin where material blockage is likely to occur. The device may be operated in continuous, timed or flow-sensor mode.

9 Claims, 8 Drawing Sheets

FIG. 1.
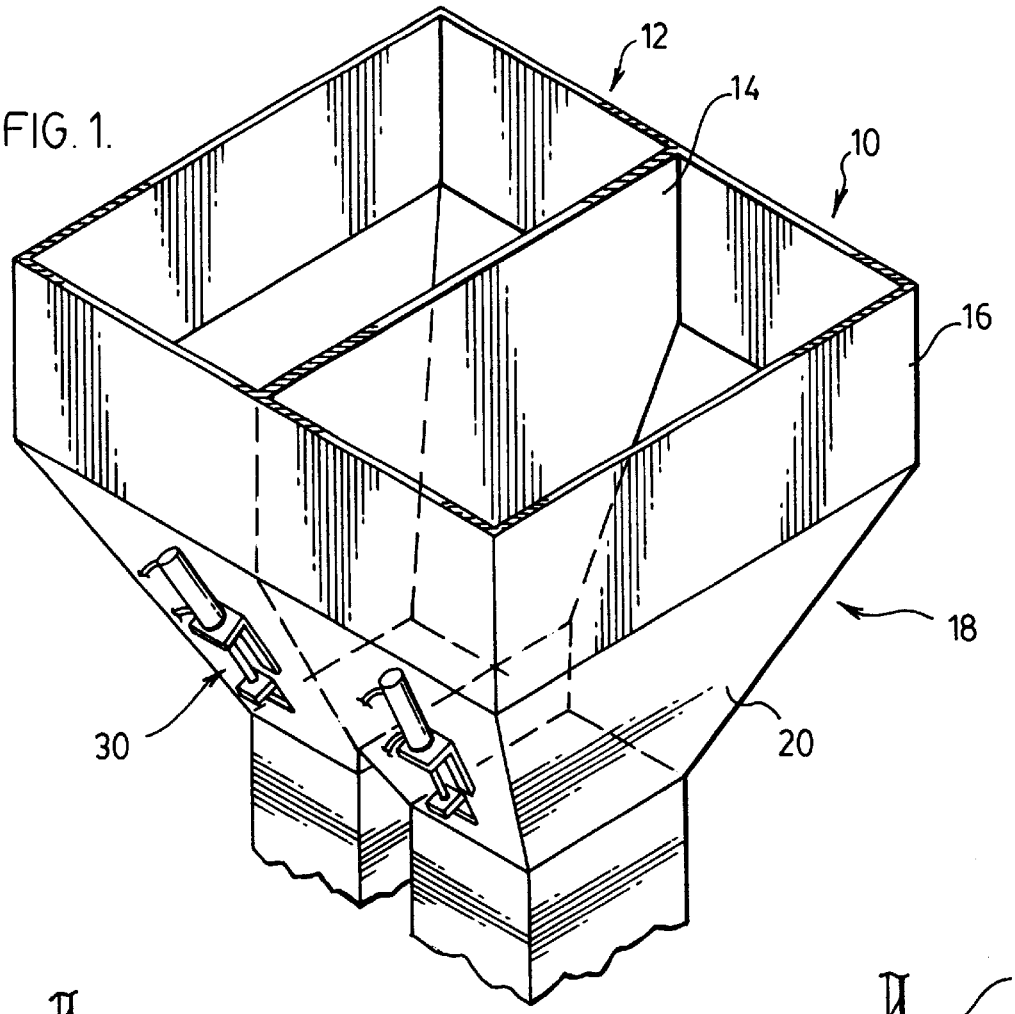
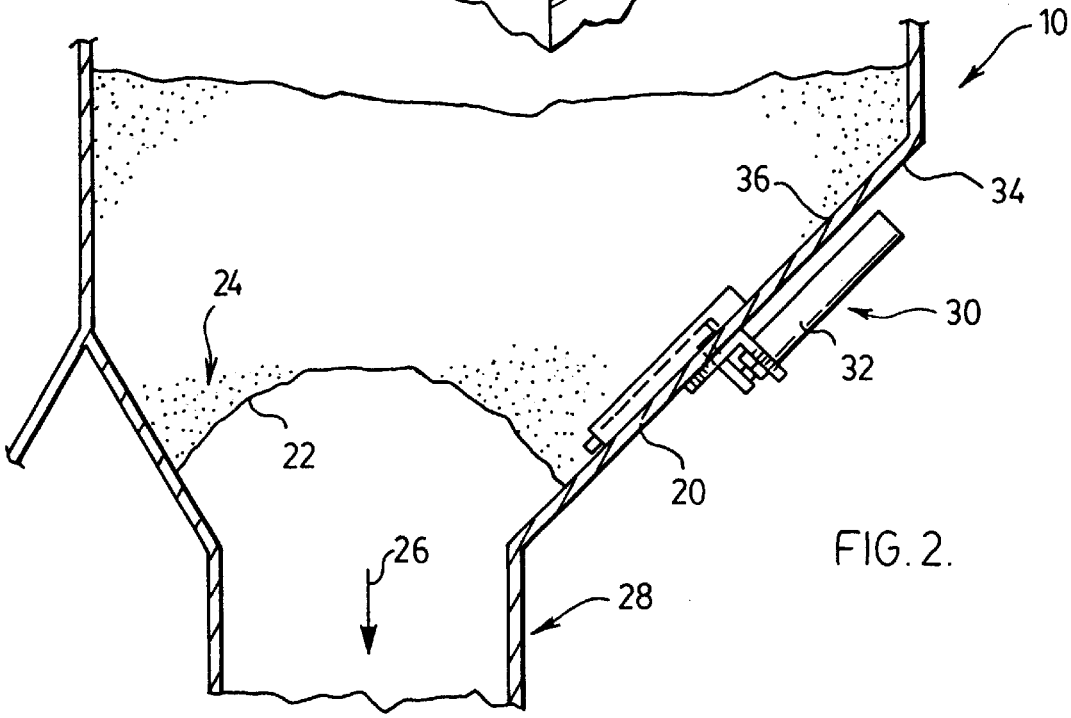
FIG. 2.

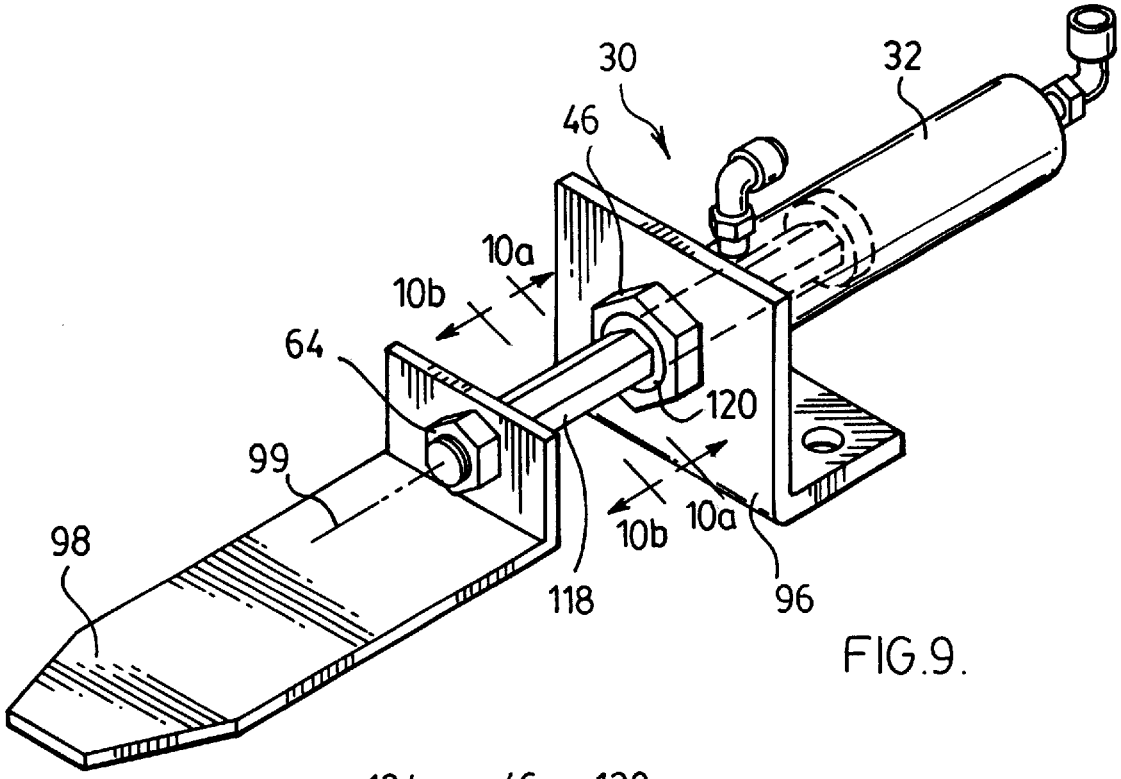
FIG.9.
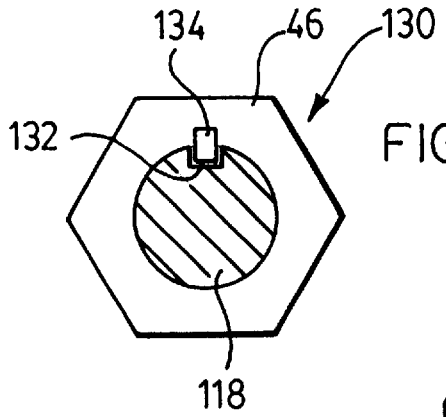
FIG.10a
FIG.10b
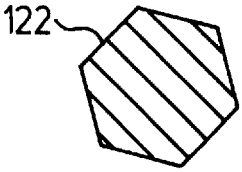
FIG.10c.
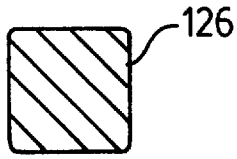
FIG.10d.
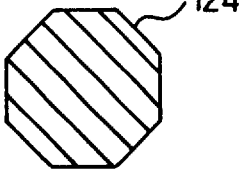
FIG.10e
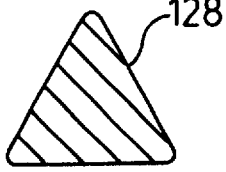

MATERIAL ACTIVATOR FOR MATERIAL DISPENSING BIN

CROSS-REFERENCE TO RELATED APPLICATIONS

This application is a continuation of U.S. application Ser. No. 60/308,850, filed Aug. 21, 2001, which is hereby incorporated herein in its entirety by reference.

FIELD OF THE INVENTION

This invention relates to a material activator for a material dispensing bin and more particularly to an activator for preventing material bridging which could interrupt flow of material through the bin outlet.

BACKGROUND OF THE INVENTION

Bins, hoppers, chutes, and the like have been employed for dispensing materials. Each of these container types has an outlet through which the material is dispensed and usually has some form of gate or valve mechanism at the outlet to stop flow of dispensed material from the container through the outlet. Dry materials in the form of powders, aggregates, granular, fines, chopped or ground materials including recycle plastics and the like when dispensed through various types of containers can cause hang up or bridging of the material above the bin outlet. The extent of bridging, hang up, and compaction of the material varies depending, for example, upon the physical characteristics of the material, electrostatic attraction of the materials and the degree of dryness.

Various techniques have been implemented to avoid material bridging. Such devices can be categorized into at least two principle areas: vibratory and mechanical. Examples of vibratory devices are described in Canadian Patent No. 1,178,934 and U.S. Pat. No. 3,715,059. The vibratory devices may be mounted on either the inside or outside of the bin wall and produce vibration in the neck area of the bin to prevent material hang up and/or bridging. However, vibratory devices, should bridging occur, can actually increase the compaction in the bridged material.

Mechanical systems involve moving devices which directly contact the material, for example, as shown in U.S. Pat. No. 4,176,767, a manually operated spring device may be pushed up into the bin outlet to break up any bridging of the material. Canadian Patent No. 1,048,457 describes scrapers which are pivotally mounted on the bin side wall and are moved up and down by lugs on a endless conveyor to prevent bridging on the tapered portions of the bin. U.S. Pat. Nos. 3,804,304 and 5,277,337 describe rotary scraper devices mounted near the tapered outlet of the bin to move the material around and physically break up any bridging action in the moving material.

Movement of material from a dispensing bin becomes particularly important when combining predetermined amounts of dispensed materials to form a batch for subsequent processing. Any hang up in any one of the material dispensing devices can greatly delay the production of the batch. This is particularly prevalent when blending plastic resins for injection molding systems. Furthermore, if the amount of the material to be dispensed is based on time it is critical that the material always flow out of the outlet at a desired flow rate so that the correct amount is metered for each batch. This may become an issue when blending plastic resins for injection molding systems. It may be that four or more different types of plastics are to be metered and dispensed. Some of these plastics may have electrostatic properties which can encourage the formation of bridges in the bin. This is particularly true with ground recycled plastic such as recycled PET (polyethylene teraphthalate).

Although it is appreciated that similar significant problems exist in dispensing fine powders such as grain flour, there continues to be a need for a compact style of material activator which is readily installed as original equipment or may be retro-fitted on existing equipment.

SUMMARY OF THE INVENTION

In accordance with an aspect of this invention, a material activator is provided for a dispensing container such as a bin, hopper, chute and the like. The activator is positioned on the bin inside wall in the tapered area of the bin where bridging naturally occurs. The activator comprises a movable slide which reciprocates along the inside wall to break up any material bridging or hang up. The actuation of the slide may be based on a timed event, a bridge sensing device, or a flow sensor.

According to an aspect of the invention, provided is a material activator device for use in maintaining material flow from a material dispenser, said device comprising:

i) a mount for mounting said device to said material dispenser;

ii) a reciprocal slide for movement through the region in which material blockage is likely to occur; and iii) an actuator having a reciprocal piston rod connected to said slide.

According to another aspect of the invention, provided is a method of maintaining material flow in a material dispenser, said method comprising reciprocating a slide through the material in the region in which material blockage is most likely to occur to thereby prevent material blockage and maintain material flow.

BRIEF DESCRIPTION OF THE DRAWINGS

Preferred embodiments of the invention are shown in the drawings wherein:

FIG. 1 is a perspective view of a twin bin dispensing system particularly adapt to dispense granular plastics.

FIG. 2 is a section through one of the bins of FIG. 1.

FIG. 9 is a perspective view of another embodiment of the material activator.

FIG. 10 are sectional views through the reciprocating piston rod of the embodiment of FIG. 9.

DETAILED DESCRIPTION OF THE PREFERRED EMBODIMENTS

Figure 3:
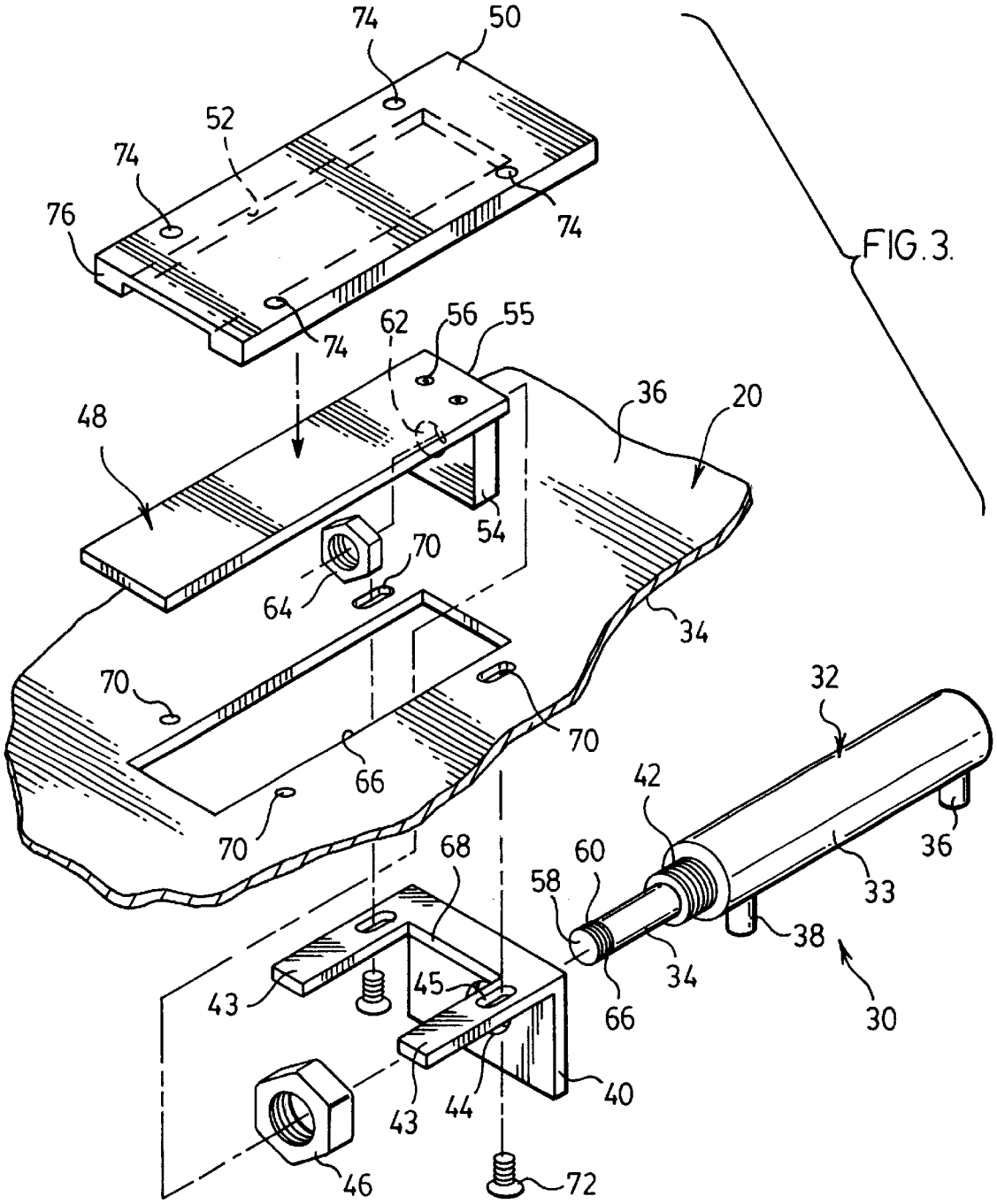
FIG. 3 is an exploded view of the material activator of this invention.

With reference to FIG. 1, two dispensing bins (10) and (12) share a common wall (14). The bins which may also be referred to as containers, chutes, hoppers and the like have the characteristic side wall portions (16) which are vertical. The lower region (18) of the bin is provided with the inwardly tapered walls (20). It is appreciated that the bins may be rectangular in section as shown or could be square, or could be cylindrical, hence, the tapered section (18) may have planer walls (20) as shown or may have cylindrical walls should the container be circular. Regardless, the bin (10) as shown in FIG. 2 can develop a bridging of the material as shown by line 22. Bridging occurs as the material (24) compacts and forms the arch as shown at 22 and prevents material from falling down in the direction of arrow (26) and flowing out of the bin (10) through the outlet (28).

In accordance with this invention, a material activator (30) can be mounted on the tapered portion (18) of the bin tapered wall (20) to either break up or minimize bridging of the material (24) as it is dispensed from the hopper (10). The material activator (30) may have its actuator part (32) mounted on the outside (34) of the wall (20) or on the inside (36) of the wall (20) both embodiments to be described with respect to FIGS. 4 and 5.

The details of the material activator (30) are shown in more detail in FIG. 3. The actuator (32) may be a pneumatic or hydraulic device with a reciprocal piston rod (34). Pressurized fluid is supplied to the cylinder (33) through the appropriate pressurized inlet and outlet conduits (36 and 38). The cylinder (32) may be mounted on bracket (40) by securing threaded portion (42) in the opening (44) of bracket (40) by use of lock nut (46). The material activator comprises a slide (48) which is mounted on the inside (36) of wall (20). The slide (48) is housed within a slide enclosure (50) which has a rectangular shaped channel (52) (shown in dot) and which is designed to cover the slide (48). The slide (48) has a lug (54) secured to the slide (48) by screws or the like (56). The distal end (58) of the piston rod (34) has a threaded portion (60). The threaded portion (60) is passed through the opening (62) as shown in dot. Lug (54) is secured in place by lock nut (64). A shoulder (66) is provided on the piston (34) to locate the lug (54) on the piston rod (34). The lug (54) projects through the opening (66) which is formed in the wall (20). The lug as well extends through the U-shaped cut out (68) in the bracket (40). The slide enclosure (50) is secured to the inside (36) of the wall (20) by use of screws extending through openings (70) in the bin wall (20). Threaded bolts (72) may extend through the opening (70) and be threaded into the threaded bores (74) provided in the slide enclosure (50).

It is appreciated that the opening (66) permits movement of the slide lug (54) a sufficient distance to break up the bridging of material. The slide (48) does not move beyond the end (76) of the enclosure (50). This prevents material escaping from underneath the enclosure (50) and out through the opening (66). It is also appreciated that if the actuator (32) is mounted on the inside wall of the bin, the slide opening (66) is not required.

Figure 4:
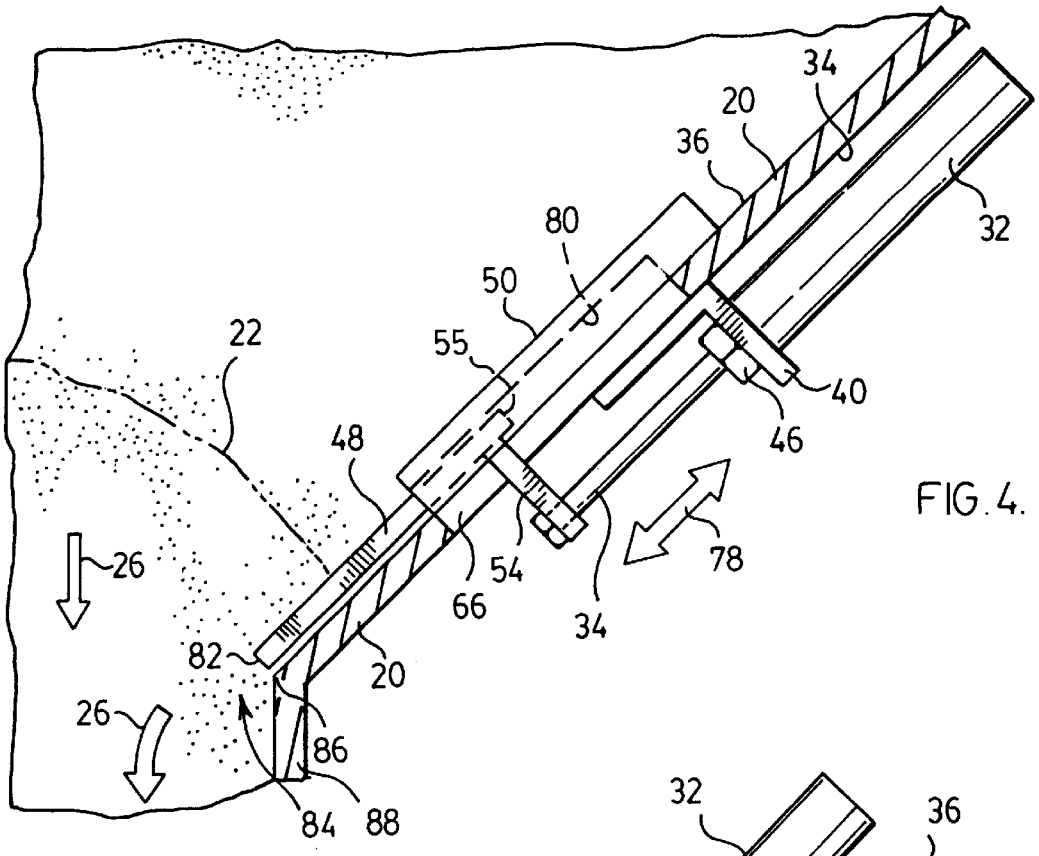
FIG. 4 is a section through the activator with the actuator system mounted on the outside of the bin.

With reference to FIG. 4, the mounting of the actuator assembly of FIG. 3 is shown. The actuator (32) is secured to the bracket (40) by nut (46), the bracket in turn is secured to the outside (34) of the wall (20). The bracket as shown may be L-shaped with its lower legs (43) having the apertures (45) formed therein to permit securement of the legs (43) to the outside of the wall (20). The slide lug (54) is free to reciprocate along the opening (66) by viture of reciprocal movement in the direction of arrow (78). The piston rod (34) is reciprocated back and forth by alternating the supply of pressurized fluid whether it be air or hydraulic oil to the conduits (36 and 38) of the actuator (32). The material activator has the enclosure (50) located on the inside wall (36) in the manner shown to cover the slide (48). The inner end (55) of the slide (48) remains within the closed end channel (80) of the enclosure (50) to prevent material from escaping through the openings (66). The enclosure (50) is position to ensure that for the travel of the slide (48) the distal end (82) of the slide projects down to the neck region (84) of the bin which is usually defined by the juncture (86) of the side wall (20) with the outlet wall (88). Movement of the slide (48) back and forth avoids any significant bridging (22) developing so that material continues to flow freely in the direction of arrows (26).

Figure 5:
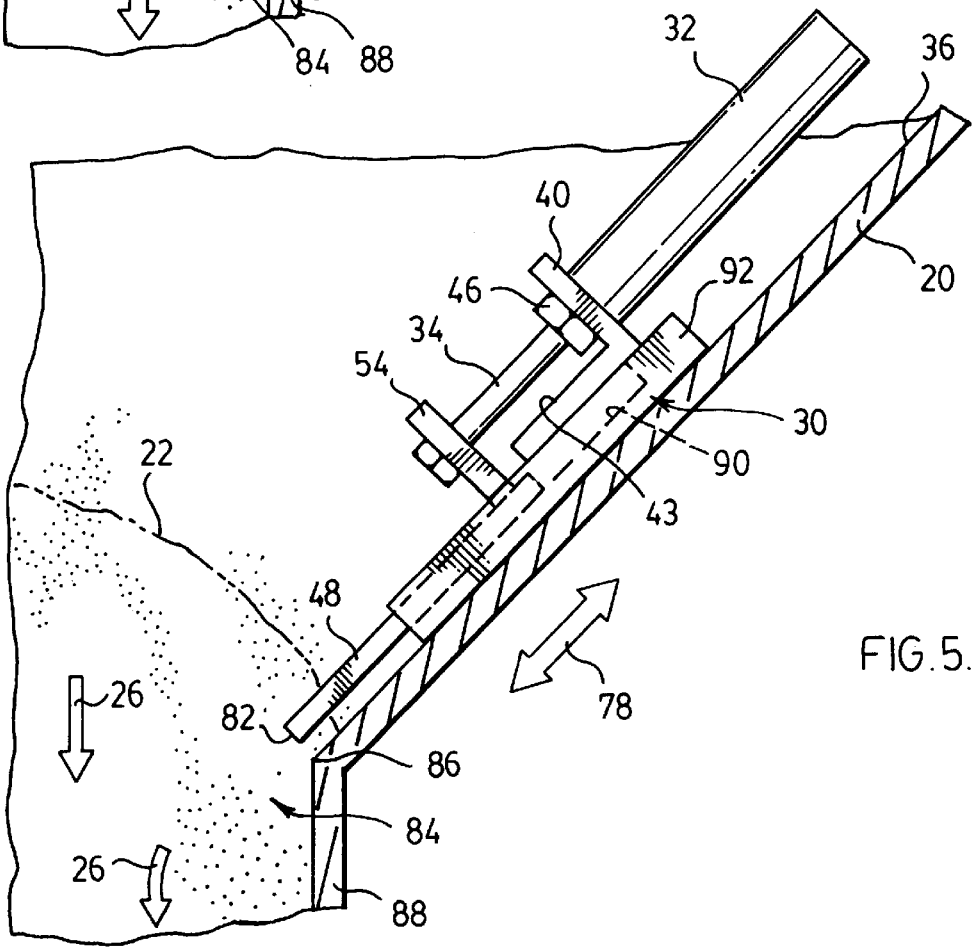
FIG. 5 is a section through the material activator with the actuator mounted on the inside of the bin.

The alternative mounting arrangement for the material activator (30) is shown in FIG. 5. The slide (48) is mounted in a channel portion (90) which is cut out of a base plate (92). The channel (90) and base plate (92) may resemble the slide enclosure (50), only turn over. The channelled base plate (92) is secured to the inside wall (36) of the bin tapered wall (20). The bracket (40) for the actuator (32) may then be secured to the base (92) with the legs (43) extending to each side of the channel (90). The slide lug (54) is free to reciprocate to the direction of arrow (78). The base (92) is mounted on wall (20) in a position such that the distal end (82) of the slide (48) projects down into the neck region (84) of the container which in this particular embodiment is defined by the region where the side wall (20) joins the outlet wall (88) as represented by juncture (86). It has been found that in mounting the actuator (32) on the inside of the bin there is no significant material hang up above the cylinder (33). Perhaps vibrations produced by the actuator reciprocating back and forth prevents material hanging up on the actuator (32). As to the material activator slide (48) reciprocating back and forth, it functions in the same manner as described with respect to FIG. 4 in breaking up any potential bridging along line 22 so that material always flows freely in the direction of arrow (26).

Figure 6:
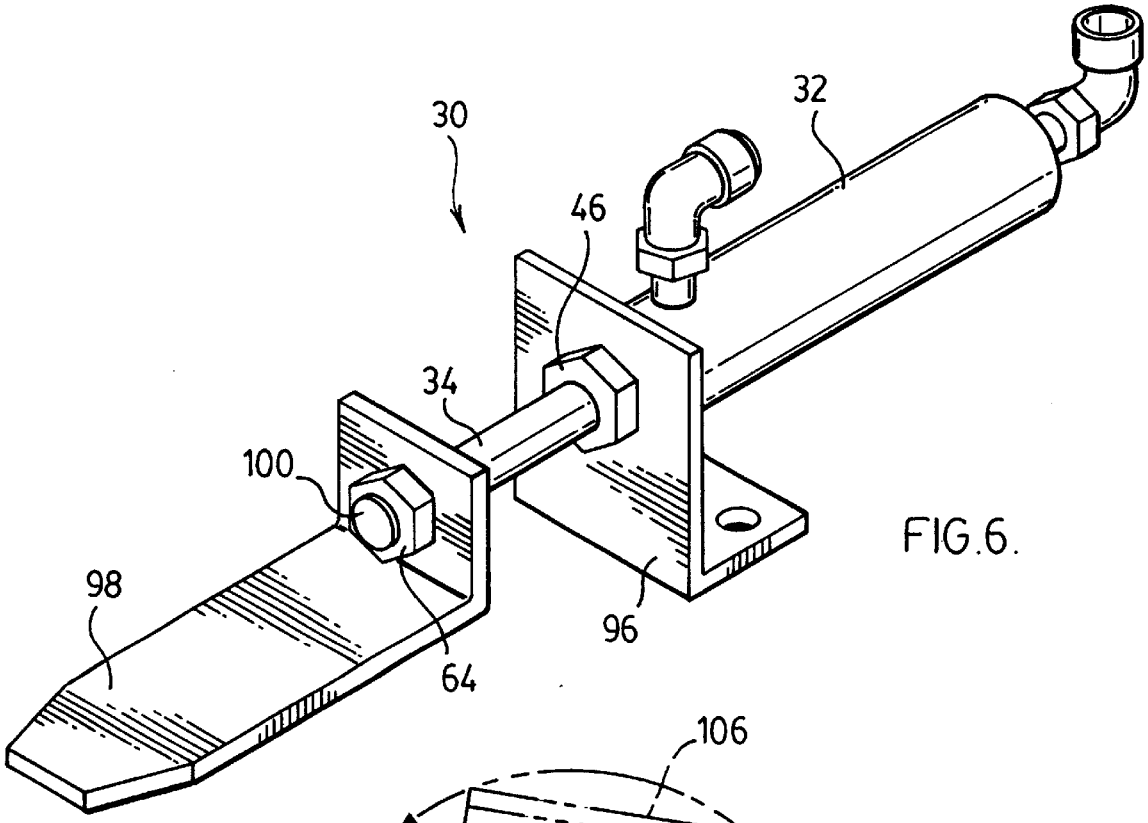
FIG. 6 is a perspective view of an alternate embodiment of the material activator.
Figure 7:
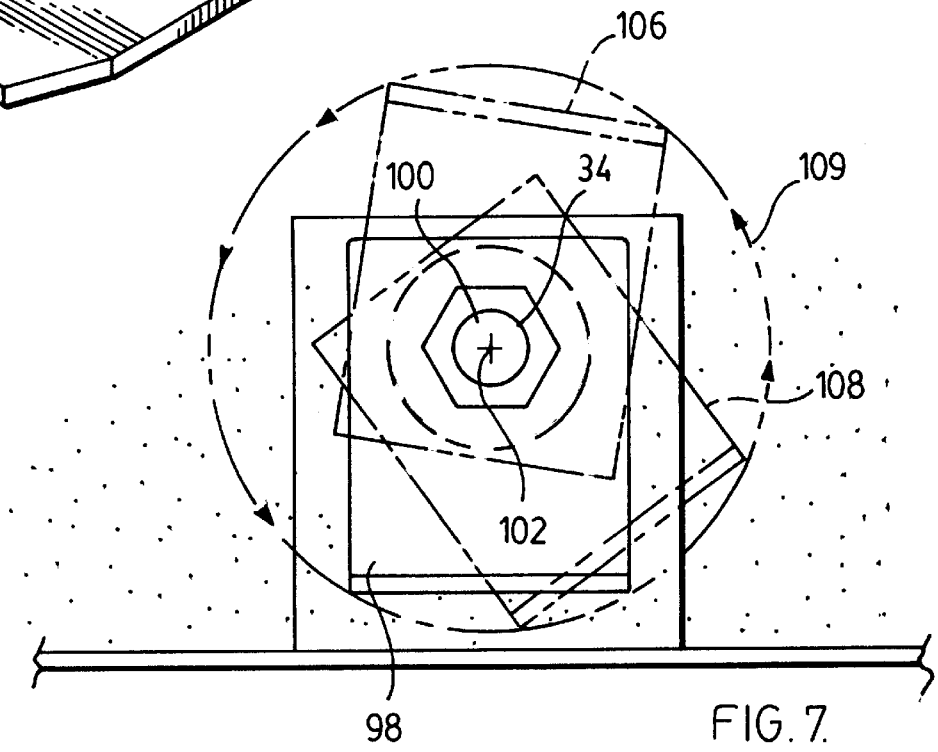
FIG. 7 is a front view of the alternate embodiment of FIG. 6 showing the rotation of the slide about the longitudinal axis of the assembly.
Figure 8:
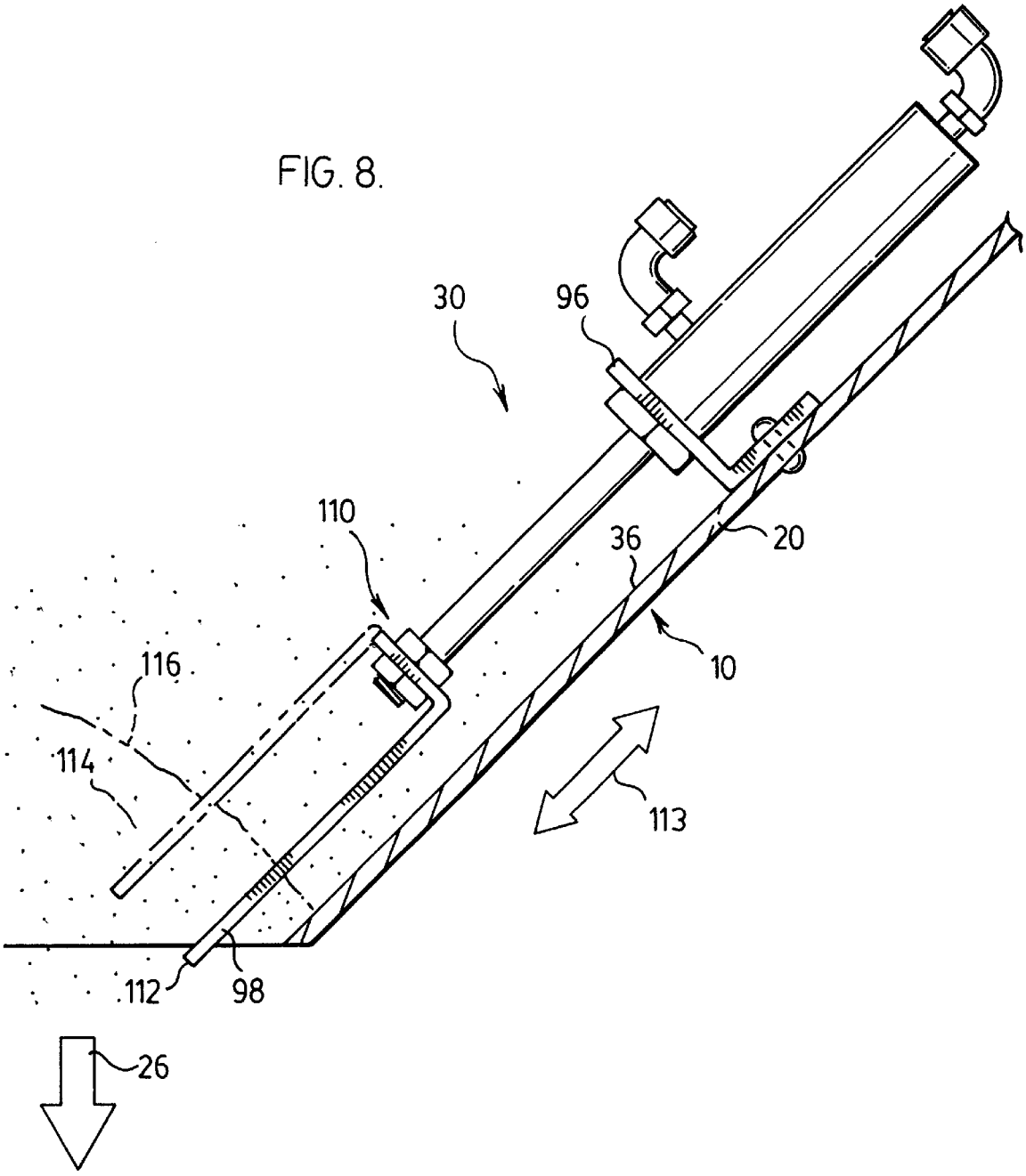
FIG. 8 is a side view of the alternate embodiment of FIGS. 6 and 7 showing the assembly engaging a material bridge.

An alternate embodiment of the material activator (30), designed for attachment to the inside surface of a material dispenser, is shown in FIGS. 6, 7 and 8. In FIG. 6, an assembled material activator (30) is shown with a mounting bracket (96) secured to the threaded portion (not shown) of the cylinder (32) by use of a lock nut (46), and where a slide (98) is secured to the reciprocating piston rod (34) by means of a lock nut (64). As can be appreciated in FIG. 7, the reciprocating piston rod (34), having a circular cross-section (100), is allowed to rotate about the longitudinal axis of the assembly (shown as crosshair at 102), permitting the attached slide (98) to also rotate about the same (examples of two alternate locations of slide (98) shown by dashed lines at 106 and 108) thus allowing for contact with bin material over a larger area (perimeter of area shown in dashed lines at 109). FIG. 8 shows the material activator (30) attached to the inside surface of a dispensing bin (10). The bracket (96) is secured to the inside surface (36) using a suitable means for attachment. The reciprocating piston rod/slide assembly (110) is free to reciprocate in the direction of arrow (112). The material activator (30) is mounted on wall (20) in a position such that the distal end (112) of the slide (98) projects down through the area (114) where a material bridge (116) is likely to occur so that material flows freely in the direction of arrow (26).

FIG. 9 shows another embodiment of the material activator (30). An assembled material activator (30) is shown with a mounting bracket (96) secured to the threaded portion (not shown) of the cylinder (32) by use of a lock nut (46), and where a slide (98) is secured to a reciprocating piston rod (118) by means of a lock nut (64). In this embodiment, the reciprocating piston rod (118), and the opening (120) of the cylinder (32) have matching non-circular cross-sections, preventing rotation of the reciprocating piston rod (118), and the attached slide (98), about the longitudinal axis (99) of the assembly.

It is appreciated that the reciprocating piston rod (118) of the embodiment depicted in FIG. 9 may take numerous non-circular cross-sectional configurations, examples of which are shown in FIG. 10 at 122, 124, 126 and 128. Also shown at 130 is an example of a circular cross-sectional configuration that incorporates a box-shaped slot (132) along the surface and length of the reciprocating piston rod (118) parallel to the longitudinal axis where a pin (134), retained by a suitable means to the lock nut (46), resides in the box-shaped slot (132) to prevent rotation of reciprocating piston rod (118) about the longitudinal axis of the assembly.

Figure 11:
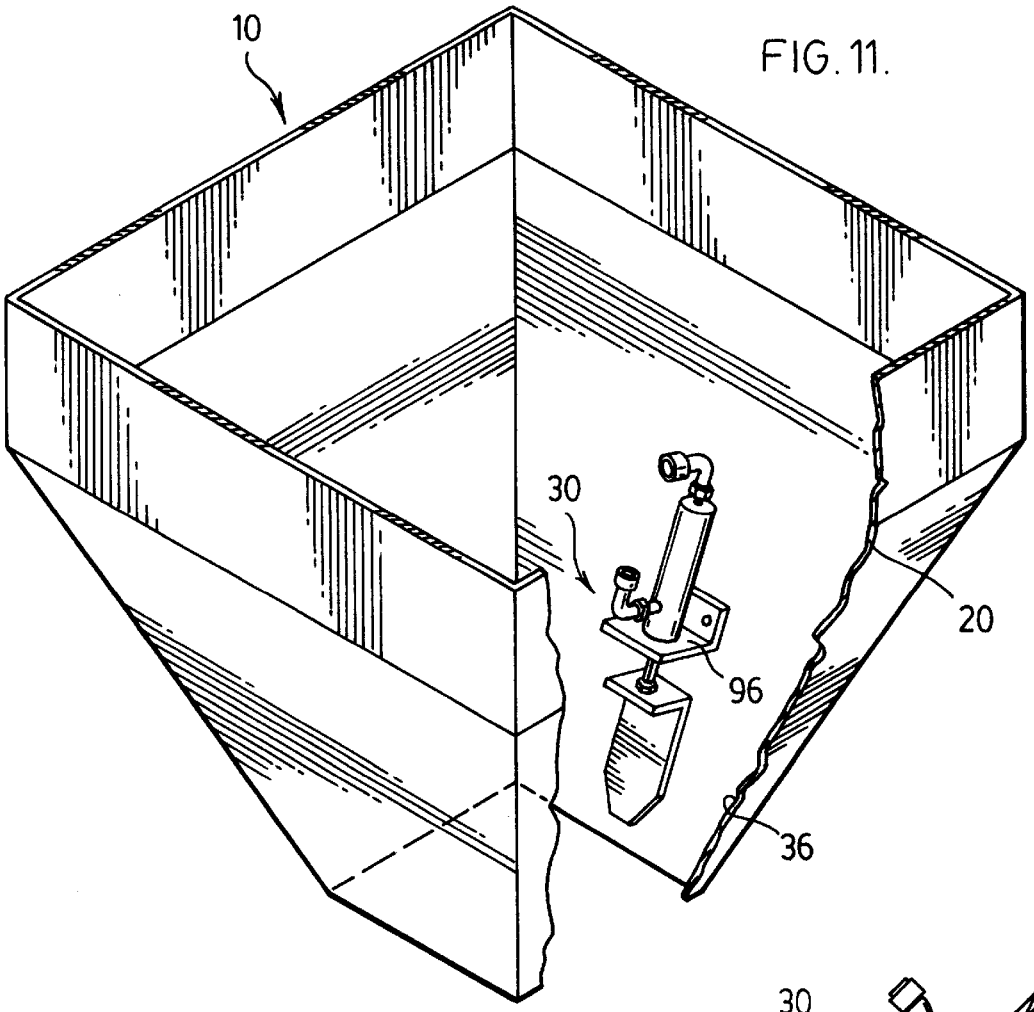
FIG. 11 is a perspective view of a bin particularly adapted with the embodiment of FIG. 9 to dispense materials.
Figure 12:
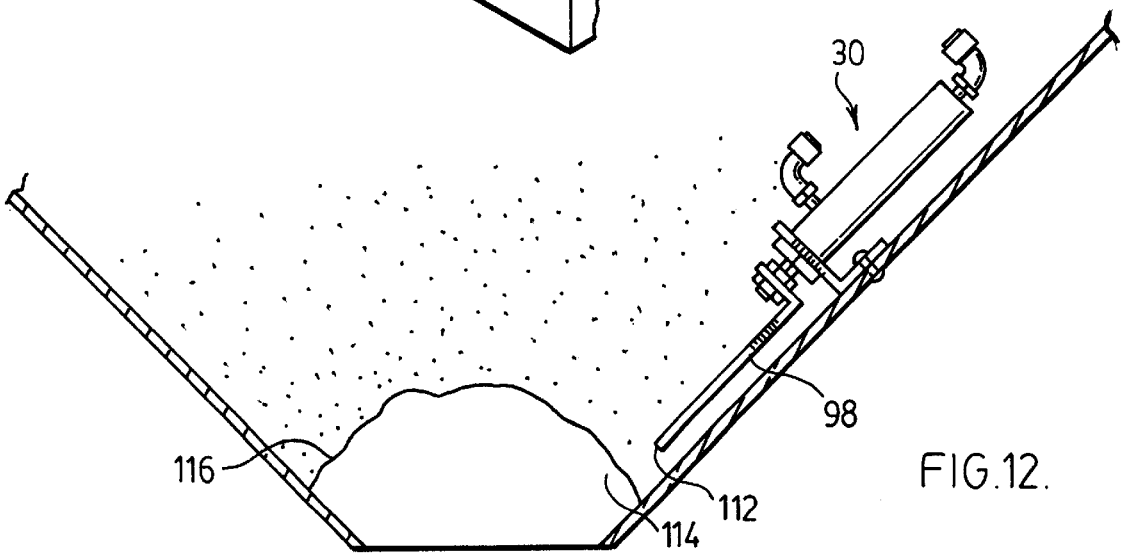
FIG. 12 is a section through a bin showing mounted to the inside surface of the bin the embodiment of FIG. 9.
Figure 13:
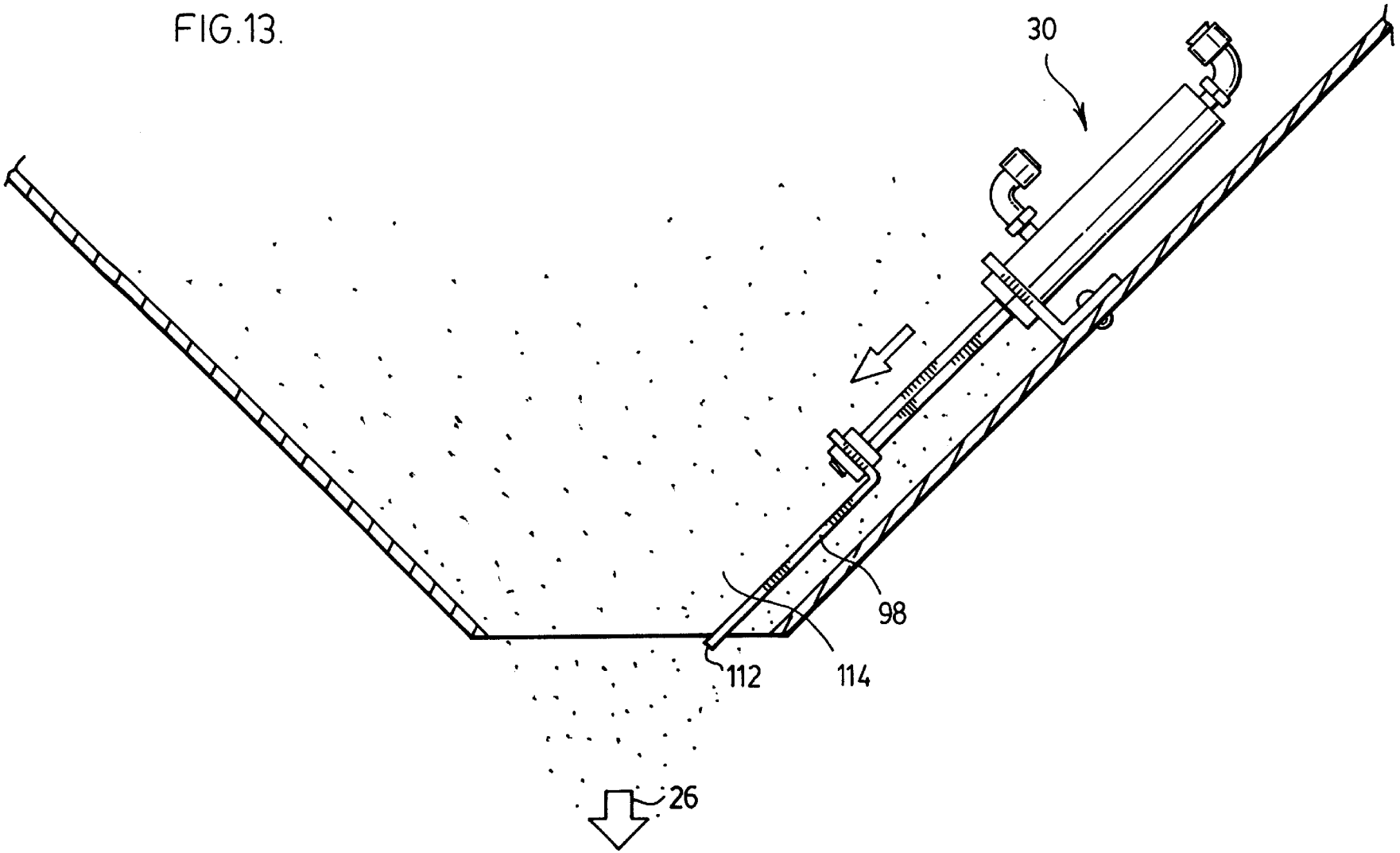
FIG. 13 is a section through a bin showing mounted to the inside surface of the bin the embodiment of FIG. 9 while engaging a material bridge.

In FIGS. 11, 12 and 13, the embodiment of FIG. 9 is shown mounted to the inside surface (36) of a bin (10). In FIG. 11, the material activator (30) is shown mounted to the inside surface (36) of the wall (20) by the mounting bracket (96) using a suitable means for attachment. In FIGS. 12 and 13, the material activator (30) is shown in a position that allows the distal end (112) of the slide (98) to project down through the area (114) where a material bridge (116) is likely to occur so that material flows freely in the direction of arrow (26). The reciprocating piston rod (118) of non-circular cross-section, reciprocates within a corresponding non-circular cross-sectional opening (120) in said cylinder (32) thereby preventing rotation of reciprocating piston rod (118) about its longitudinal axis. The non-circular cross-section of the opening (120) in the cylinder (32) ensures that the reciprocating piston rod (118) and the attached slide (98) remain in a fixed non-rotative position with respect to the longitudinal axis (99) of the assembly.

The operation of the material activator may be controlled in several different ways. The purpose of the material activator is to activate the material in a way that free flow of material is reasonably constant. The actuator (32) can be operated continuously to constantly reciprocate back and forth to ensure free flow of material. This action however may not be needed in all circumstances. Alternatively the actuator (32) may be activated on a cyclical basis for example on a cycle of every five to fifteen seconds. Another alternative would be to have a flow sensor in the outlet (84). When the sensor determines that there is a decrease in the flow rate of the material or material flow disappears all together, the sensor in turn sends a signal to activate actuator (32) to reciprocate the slide (48) to break up any bridging which has occurred above the outlet (84). It is appreciated that such controls can be implemented in a variety of ways which would be readily apparent to those skilled in the art and any combination of these suggested control features may be used on the material activator.

In accordance to this invention, a surprisingly simple system has been devised to provide material bridging break up in a dispenser, bin container, hopper and the like. The device can be installed as original equipment or may be retro fitted on existing equipment. The system is readily accessed should there be any fault in the material activator it can be readily repaired and put back into use. The system may be used on several types of material dispensing bins, for example, those used in the plastics industry for injection molding; blow molding injection/blow molding and extrusion systems, the pharmaceutical industry and the food industry.

Although preferred embodiments of the invention have been described herein in detail, it will be understood by those skilled in the art that variations may be made thereto without departing from the spirit of the invention.

I claim:

1. A material activator device for use in maintaining material flow from a material dispenser, said device comprising:

i) a mount for mounting said device to said material dispenser;

ii) a reciprocal slide for movement through the region in which material blockage is likely to occur; and iii) an actuator having a reciprocal piston rod connected to said slide, iv) wherein a body portion of the actuator of said material activator device is mounted an the inside surface of the material dispenser, and further v) wherein said reciprocating piston rod is non-circular in cross-section and reciprocates within a corresponding non-circular cross-sectional opening in said cylinder thereby preventing rotation of said reciprocating piston rod about its longitudinal axis.

2. The material activator device of claim 1 where said reciprocating piston rod is hexagonal in cross-section.

3. The material activator device of claim 1 wherein said slide is attached to the terminal end of said reciprocal piston rod, said reciprocal piston rod being fixed with respect to rotation about its longitudinal axis, thereby preventing movement of said slide about the longitudinal axis of said reciprocating piston rod.

4. The material activator device of claim 1 wherein the device is mounted above the region in the material dispenser in which a material bridge will form, thereby allowing said slide to break up said material bridge by engaging said material bridge from above.

5. The material activator device of claim 1 wherein terminal end of said slide may be rectangular, tapered or circular.

6. The material activator device of claim 1 wherein said material dispenser may take the form of a bin, hopper or chute wherein the material dispenser may have a rectangular or cylindrical configuration.

7. The material activator device of claim 1 wherein said material may be selected from the group consisting of powders, aggregates, fines, granular material, chopped material and ground mated ala.

8. The material activator device of claim 1 wherein said actuator body is hydraulic, said actuator body having inlet and outlet conduits for delivery of hydraulic fluid.

9. The material activator device of claim 1 wherein said actuator body is pneumatic, said actuator body having inlet and outlet conduits for delivery of air.

* * * * *

UNITED STATES PATENT AND TRADEMARK OFFICE

CERTIFICATE OF CORRECTION

PATENT NO. : 6,708,851 B2
DATED : March 23, 2004
INVENTOR(S) : DaSilva

It is certified that error appears in the above-identified patent and that said Letters Patent is hereby corrected as shown below:

Column 6,
Line 23, after “likely to occur;” cancel “and”.
Line 25, after “said slide,” insert -- and --.
Line 57, “mated ala” should read -- materials --.

Signed and Sealed this

First Day of June, 2004

JON W. DUDAS
*Acting Director of the United States Patent and Trademark Office*